US006399552B1

(12) United States Patent
Lee et al.

(10) Patent No.: US 6,399,552 B1
(45) Date of Patent: Jun. 4, 2002

(54) AQUEOUS CLEANING SOLUTION FOR REMOVING CONTAMINANTS SURFACE OF CIRCUIT SUBSTRATE CLEANING METHOD USING THE SAME

(75) Inventors: Kwang-wook Lee, Anyang; Kun-tack Lee, Suwon; Yong-sun Ko, Suwon; Chang-lyong Song, Suwon, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/451,844

(22) Filed: Dec. 1, 1999

(30) Foreign Application Priority Data

Feb. 3, 1999 (KR) ..... 99-3512

(51) Int. Cl.[7] ..... C11D 7/08; B08B 3/00

(52) U.S. Cl. ..... 510/175; 510/477; 510/488; 510/499; 134/3

(58) Field of Search ..... 134/1, 1.3, 2, 28, 134/10, 22.19, 26, 27, 29, 3, 4, 40, 41; 438/750, 751, 752, 753; 510/175, 176, 262, 269

(56) References Cited

U.S. PATENT DOCUMENTS 3,980,587 A 9/1976 Sullivan
5,506,171 A 4/1996 Leonard et al.
5,571,447 A 11/1996 Ward et al.
5,783,495 A 7/1998 Li et al.
5,792,274 A 8/1998 Tanabe et al.
5,855,811 A * 1/1999 Grieger et al.
5,928,969 A * 7/1999 Li et al.
6,165,956 A * 12/2000 Zhang et al. ..... 510/175

FOREIGN PATENT DOCUMENTS

JP 53044437 A * 4/1978
SU 1774754 * 6/1977

* cited by examiner

*Primary Examiner*—Yogendra N. Gupta
*Assistant Examiner*—Gregory E. Webb
(74) *Attorney, Agent, or Firm*—Volentine Francos, PLLC

(57) ABSTRACT

A cleaning solution for removing contaminants from the surface of an integrated circuit substrate includes a fluoride reducing agent, an organic acid containing a carboxyl group, an alkaline pH controller and water. The pH of the cleaning solution is 3.5–8.8. The cleaning solution is used at a low temperature, such as room temperature, which is lower than that for conventional cleaning solutions. Therefore, the cleaning solution does not evaporate. Furthermore, a cleaning method using the cleaning solution does not require a pre-ashing step to reinforce the cleaning agent, nor is an alcohol rinse step required. The cleaning solution is removed by rinsing with deionized water. Therefore, the cleaning method using the cleaning solution is quicker and less costly than conventional cleaning methods.

13 Claims, 13 Drawing Sheets

AQUEOUS CLEANING SOLUTION FOR REMOVING CONTAMINANTS SURFACE OF CIRCUIT SUBSTRATE CLEANING METHOD USING THE SAME

BACKGROUND OF THE INVENTION

1. Field of the Invention

The present invention relates to an aqueous cleaning solution for removing contaminants from the surface of an integrated circuit substrate and a cleaning method using the same.

2. Background of the Related Art

Patterns of various interconnections comprising aluminum, titanium or titanium nitride, and contact holes or via holes exposing the interconnection patterns, must be formed on a substrate to complete an integrated circuit. The interconnection patterns, the contact holes and the via holes are formed through successive photo lithography, etching, ashing, cleaning, rinsing and drying processes.

The ashing process is a dry strip process for removing a resist pattern used as a mask during etching. The cleaning process is for removing contaminants, such as etching residues generated during the etching or the ashing process, for forming the interconnection pattern or the contact hole (via hole) from a surface of the integrated circuit substrate. The residues to be removed are organic polymers formed by reacting carbon C, hydrogen H or oxygen O which form a resist pattern, with an interconnection material and plasma during reactive ion etching (RIE), organic metallic polymers formed by back-sputtering the interconnection material to the sidewalls of the resist pattern and to the contact hole or to the via hole during the etching or ashing, resist residues remaining on the surface of the substrate after ashing, and an insulating material or a metallic insulating material formed by back-sputtering the insulating layer under the interconnection pattern which is exposed by over-etching.

An organic cleaning solution including a polar solvent such as alcohol, a basic amine reducing agent such as hydroxylamine, an organic acid such as catechol and a corrosion inhibitor are widely used for the cleaning solution.

However, the conventional organic cleaning solution is generally used at a high temperature of 60° C. or more to have the desired cleaning effects, so that the organic cleaning solution is vaporized which thus shortens its useable life span. Meanwhile, the cleaning solution includes a reducing agent such as a basic amine having a relatively low reducing ability, so that the etching residues such as the organic metallic polymer of a tungsten oxide or a copper oxide, which are generated during the etching of a new interconnection such as a tungsten interconnection or a copper interconnection, cannot be completely removed. Thus, the step of processing a cleaning reinforcing agent, e.g., a nitric acid may be required as a pre-ashing step to completely remove the etching residues.

Also, the conventional organic cleaning solution includes an organic component, so that when rinse is performed with only deionized water, the organic components cannot be completely removed and thus remain on the substrate. Thus, the interconnection film can be easily corroded thereby changing the profile of the interconnection pattern. Thus, a rinse process using a rinse containing alcohol such as isopropyl alcohol (IPA) is additionally required before the rinse process using deionized water. Thus, the conventional environments for the manufacturing equipment and cleaning processes are complicated. Also, the organic cleaning solution easily corrodes metals, thereby damaging the pipes carrying the cleaning solution and the cleaning equipment.

Moreover, as described above, in order to strengthen the ability to remove impurities and suppress the corrosion of the interconnection layer, the nitric acid treatment step is performed before the ashing process, or the IPA rinser treatment step must be performed before the rinse process using deionized water. This complicates the process and increases the process time, thereby reducing productivity. Also, the cleaning reinforcing agent (nitric acid) and rinser (IPA) as well as an organic cleaning solution are further required, so that the total production cost is increased. In addition, respective steps require respective baths, so that the manufacturing equipment becomes unnecessarily bulky. Also, organic cleaning solutions must be disposed of after several uses, and the disposal cost is added to the total process cost.

Also, the conventional organic cleaning solution has a low removing ability with respect to an oxide layer. As shown in FIGS. 1A and 1B, an oxide layer 20 under an interconnection pattern 30 is overetched and re-sputtered during an etching process for forming the interconnection pattern 30 on a substrate 10, and thus the re-sputtered oxide layer 50 is attached to a surface of an organic polymer 40 which has been attached to a sidewall of the interconnection pattern 30. When a conventional organic cleaning solution is used, the polymer 40 is removed while the oxide layer 50 is not completely removed. Thus, as shown in FIG. 2, the re-sputtered oxide layer 50 may lay across the adjacent interconnection patterns 30. Here, the re-sputtered oxide layer 50 is mostly a metallic oxide layer contaminated by a conductive material generated by etching, to thereby generate a bridge phenomenon between interconnections.

SUMMARY OF THE INVENTION

It is an objective of the present invention to provide a cleaning solution having an excellent ability for removing contaminants from the surface of an integrated circuit substrate, without damaging a conductive layer.

It is another objective of the present invention to provide a method for removing contaminants from the surface of the integrated circuit substrate using the cleaning solution.

Accordingly, to achieve the first objective, the cleaning solution according to the present invention includes a fluoride reducing agent, an organic acid containing a carboxyl group, an alkaline pH controller and water. The range of the pH of the cleaning solution is 3.5–8.8.

The fluoride reducing agent may be a hydrofluoride (HF), a hydroboron tetrafluoride ($HBF_4$) or ammonium fluoride ($NH_4F$), the organic acid may be acetic acid ($CH_3COOH$) or citric acid ($C_3H_4(OH)(COOH)_3$), and the alkaline pH controller may be ammonium hydroxide ($NH_4OH$), potassium hydroxide (KOH), tetramethylammonium hydroxide ($(CH_3)_4\ NH_4OH$) or tetraethylammonium hydroxide ($(CH_3CH_2)_4\ NH_4OH$).

The content of the fluoride reducing agent is 0.01–1 weight % of the total weight of the cleaning solution, the content of the organic acid containing a carboxyl group is 1–50 weight % of the total weight of the cleaning solution and the content of the alkaline pH controller is 0.25–15 weight % of the total weight of the cleaning solution.

To achieve the second objective, the method for removing impurities from an integrated circuit substrate includes the step of applying a cleaning solution to the surface of the integrated circuit substrate wherein the cleaning solution contains a fluoride reducing agent, an organic acid containing a carboxyl group, an alkaline pH controller and water.

The contaminants are at least of one an etching residue, polymer, an organic metallic polymer, a silicon oxide layer or a contaminated silicon oxide layer, and the surface of the integrated circuit substrate is partially metallic.

According to the cleaning solution of the present invention, the organic polymer, the organic metallic polymer and the oxide layer can be effectively removed and the conductive layer is not damaged.

BRIEF DESCRIPTION OF THE ATTACHED DRAWINGS

The above objectives and advantages of the present invention will become more apparent by describing in detail a preferred embodiment thereof with reference to the attached drawings in which.

Figure 10A:
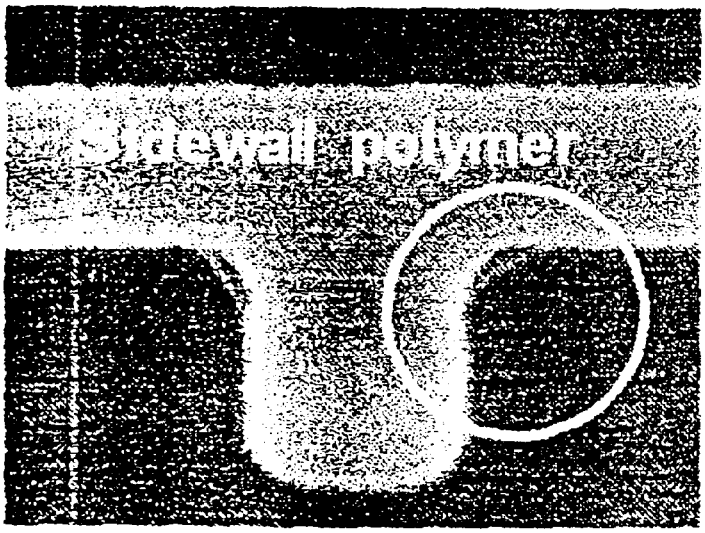
Figure 10B:
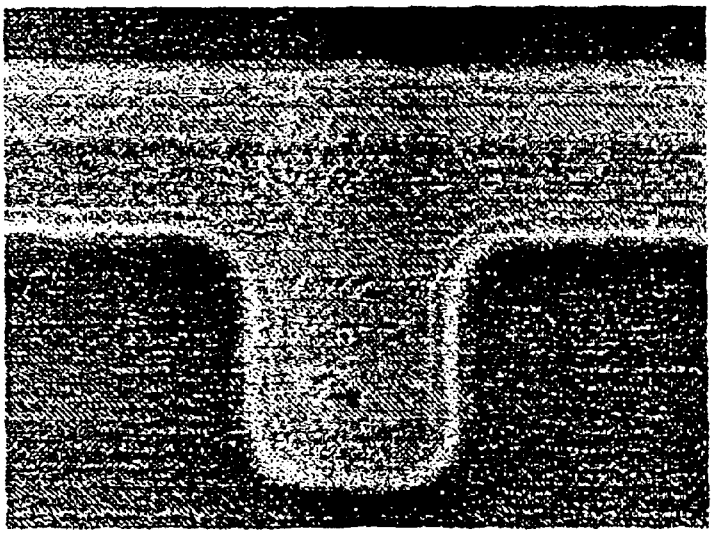
Figure 11:
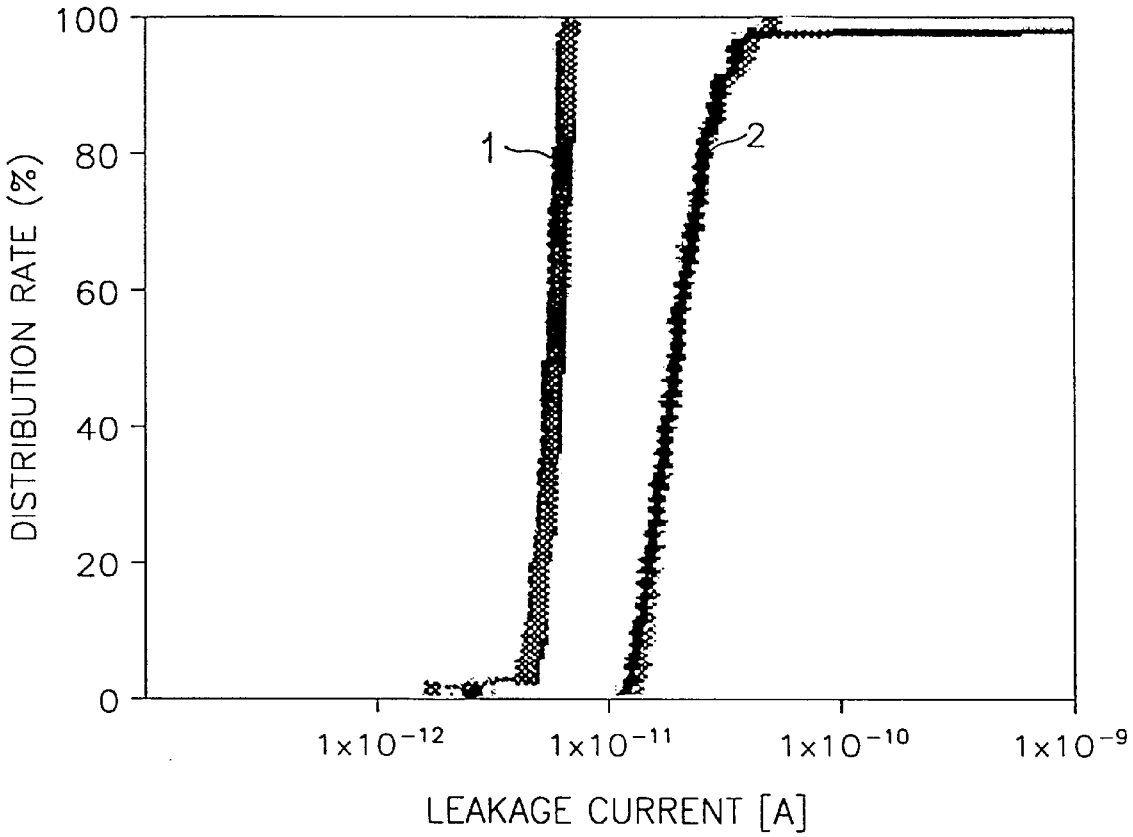

FIGS. 8A through 8D are SEM cross-sectional photographs of a tungsten interconnection not treated by a cleaning solution, a tungsten interconnection treated by a conventional cleaning solution, and a tungsten interconnection treated by the cleaning solution according to the present invention for a cleaning time which is varied, to measure optimum cleaning time of the cleaning solution according to the present invention;

FIGS. 9A through 9D are SEM cross-sectional photographs of tungsten interconnections treated by the conventional cleaning solution and the cleaning solution according to the present invention;

FIGS. 10A and 10B are SEM photographs of the top surface of tungsten interconnections fabricated by using the conventional cleaning solution and the cleaning solution according to the present invention; and FIG. 11 is a graph showing the result of leakage current measured in tungsten interconnections fabricated by using the conventional cleaning solution and the cleaning solution according to the present invention.

DETAILED DESCRIPTION OF PREFERRED EMBODIMENTS

A cleaning solution according to the present invention includes a reducing agent of the fluoride, an organic acid containing a carboxyl group, an alkaline pH controller and water.

The cleaning solution includes 0.01–1 wt % of the fluoride reducing agent, 1–50 wt % of the organic acid containing the carboxyl group and 0.25–15 wt % of the pH controller.

From the viewpoint of production efficiency of semiconductor devices, it is preferable that the cleaning time be limited to 30 min or less, and when the content of the fluoride reducing agent is less than 0.01 wt %, the cleaning effect is insufficient during the limited cleaning time. However, when the content of the fluoride reducing agent is more than 1 wt %, an interconnection layer or a barrier metallic layer such as a titanium layer may corrode. When the content of the organic acid containing the carboxyl group is less than 1 wt %, polymers decomposed by the reducing agent cannot be sufficiently dissolved. It is preferable that the maximum content of the organic acid is 50 wt % from the viewpoint of an effective cleaning process and the process margin. Preferably, the content of the pH controller, which is relatively determined according to the content of the fluoride reducing agent and the organic acid, is 0.25–15 wt %.

The pH range of the cleaning solution of the above composition is 3.5–8.8. A cleaning solution of a pH of less than 3.5 damages the interconnection material. Particularly, a strong acidic cleaning solution of a pH of less than 3.5 damages the titanium layer formed as a diffusion barrier layer, to thereby lift the interconnection pattern. In contrast, a cleaning solution of a pH of greater than 8.8 shows remarkably reduced polymer removing ability. The cleaning solution of pH 6–8.8 can remove the polymers, but the polymers may not be perfectly removed. Thus, it is preferable that the pH of the cleaning solution is 3.5–6.

Hydrofluoride (HF), hydroboron tetrafluoride ($HBF_4$) or ammonium fluoride ($NH_4F$) are appropriate for the fluoride reducing agent according to the present invention.

Acetic acid ($CH_3COOH$) or citric acid ($C_3H_4(OH)(COOH)_3$) may be used for the organic acid containing the carboxyl group.

Ammonium hydroxide ($NH_4OH$), potassium hydroxide (KOH), tetramethylammonium hydroxide $(CH_3)_4NH_4OH$ or tetraethylammonium hydroxide $(CH_3CH_2)_4NH_4OH$ may be used for the alkaline pH controller.

The cleaning solution according to the present invention has an excellent removing ability of the etching residue. Particularly, the cleaning solution has excellent removing ability of the organic metallic polymer and an oxide generated during the formation of the interconnection pattern or a contact hole (via hole) exposing the interconnection pattern. The cleaning solution of the present invention cannot corrode the interconnection material, so that it is very effective at removing the contamination material from the surface of the integrated circuit substrate on which the interconnection pattern is exposed. Also, the cleaning solution of the present invention can etch the surface of the insulating layer which is partially contaminated during the dry etching, to thereby remove the contaminated layer.

The cleaning mechanism of the cleaning solution according to the present invention is as follows.

The reducing ability of fluorine ions (F−) of the fluoride reducing agent is high. Thus, the organic metallic polymers or a metal in the metallic oxide is reduced.

The organic metallic polymer (chemical formula I below) is a polymer formed by combining a polymer $P_R$, an etching or ashing residue, with a metal M and oxygen O. When the metal in the organic metallic polymer I is reduced by fluorine ions, the bonds between carbon of the polymer residue and the metal are broken as shown in reaction formula 1, which results in chemical formula II below.

Reaction formula 1

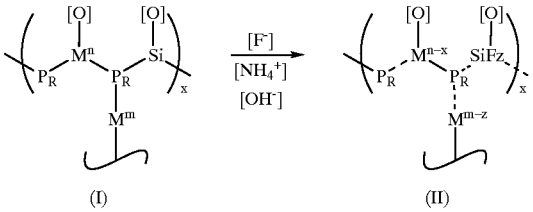

(I) (II)

Here, —(O) indicates —O, —OH or —OR, and R of the —OR group indicates a hydrocarbon group.

Also, as shown in reaction formula 1, ammonium ions and hydroxy ions generated from the pH controller as well as the fluorine ions act as the reducing agent.

The reduced metal chelation-reacts with the organic acid containing the carboxyl group, to thereby form a compound such as chemical formula III. As a result, the organic metallic polymer is decomposed by the chelation-reaction.

(III)

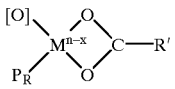

Here, R' indicates a hydrocarbon group.

Also, the metal in the metallic oxide which is the etching residue is reduced by a reducing agent such as fluorine ions, and the oxide layer is reduced by the fluoride reducing agent. A reducing reaction is expressed by reaction formulas 2 and 3. In these reaction formulae, hydrofluoride and tungsten oxide are used as the reducing agent and the metallic oxide, respectively.

(Reaction formula 2)

$$2HF \longleftrightarrow HF_2^- + H^+$$

$$SiO_2 + 2HF_2 + 2H_3O^+ \longleftrightarrow SiF_4 + 4H_2O$$

(Reaction formula 3)

$$WO_3 + 6HF \longleftrightarrow WF_6 + 3H_2O$$

The etching residue reduced by the fluoride reducing agent or the etching residue chelation-reacted with the organic acid is dissolved by water, a polar solvent, in the cleaning solution.

The organic acid according to the present invention suppresses corrosion or damage of the interconnection exposed on the surface of the integrated circuit substrate as well as acts as a solvent. A metallic oxide layer is mostly formed on the surface of an interconnection pattern exposed on the surface of the integrated circuit substrate. When the metallic oxide layer is reduced into metal ions by reacting with the reducing agent in the cleaning solution, the organic acid chelation-reacts with the metal ions to form a chelation compound. As a result, the surface of the exposed metal interconnection pattern is covered with the stable chelation compound, so that corrosion or damage to the surface is effectively prevented.

The pH controller according to the present invention controls the pH in order to maintain the reducing ability of the compound of the fluoride reducing agent of the cleaning solution and minimize damage to the metal interconnection pattern. The pH range of the cleaning solution controlled by the pH controller is 3.5–8.8.

The steps of manufacturing an integrated circuit using the cleaning solution according to the present invention will be described with reference to FIG. 3.

A resist pattern is formed on the integrated circuit substrate by a photolithographic process (step 300). Subsequently, an object to be patterned, e.g., an interconnection layer or an insulating layer, is etched by plasma etching or reactive ion etching (RIE), using the resist pattern as a mask (step 310). After etching, the resist pattern used as the mask is removed by ashing (step 320).

Subsequently, impurities on the integrated circuit substrate are removed by applying the cleaning solution according to the present invention (step 330). Here, the removed impurities are polymers, organic metallic polymers, an oxide or resist residue generated by the etching or ashing.

To apply the cleaning solution, the substrate may be placed into a bath containing the cleaning solution, or the cleaning solution may be sprayed onto the substrate.

In the case of the cleaning solution according to the present invention, the cleaning process may be performed at 60° C. or less, particularly, at room temperature. Since the cleaning process can be performed at a low temperature, the cleaning solution does not evaporate. Thus, the amount or the concentration of the cleaning solution is not changed, resulting in a useable life span of the cleaning solution that is longer than that of the conventional cleaning solution requiring a high temperature process.

The cleaning solution of the present invention can be in contact with the substrate for a long time without the interconnection layer being corroded or damaged. However, preferably, the contact time is 5–20 min, in order to enhance process efficiency and completely remove impurities from the surface of the substrate.

After the cleaning, the rinse step for completely removing the cleaning solution, dissolved polymer and the metal material from the substrate is performed (step 340). The rinse may be performed using deionized water, and may be performed in two steps if necessary. The deionized water remaining on the substrate is removed by drying the substrate through a spin dry method or a drying method using isopropyl alcohol (step 350).

Figure 1A:
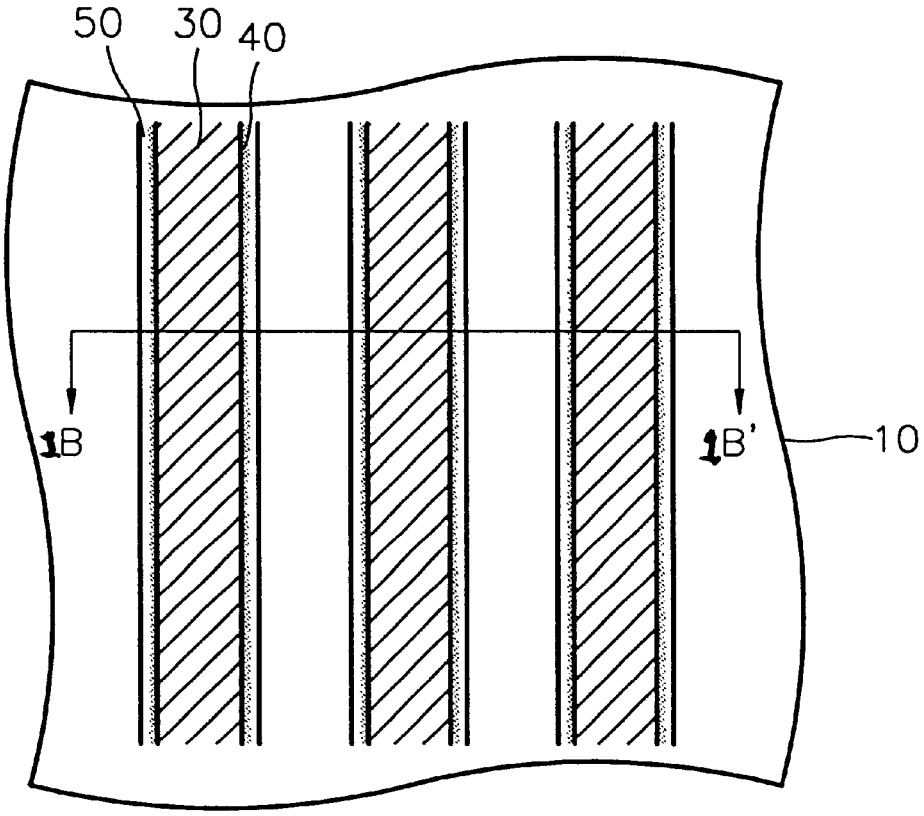
FIG. 1A PRIOR ART
FIG. 1A is a plan view of a conventional interconnection pattern in which ashing is completed.
Figure 1B:
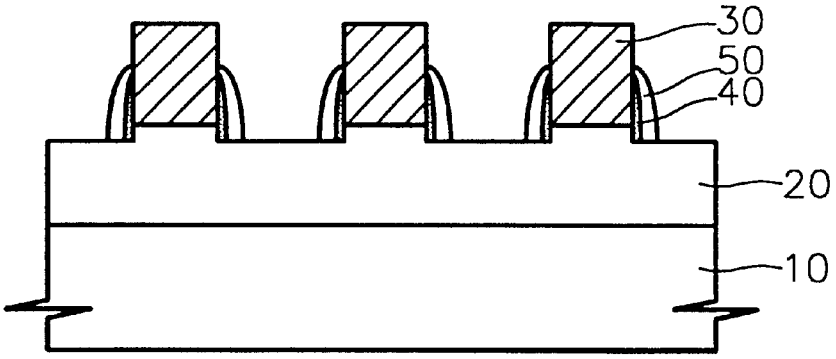
FIG. 1B PRIOR ART
FIG. 1B is a sectional view taken along line 1B–1B' of FIG. 1A.
Figure 2:
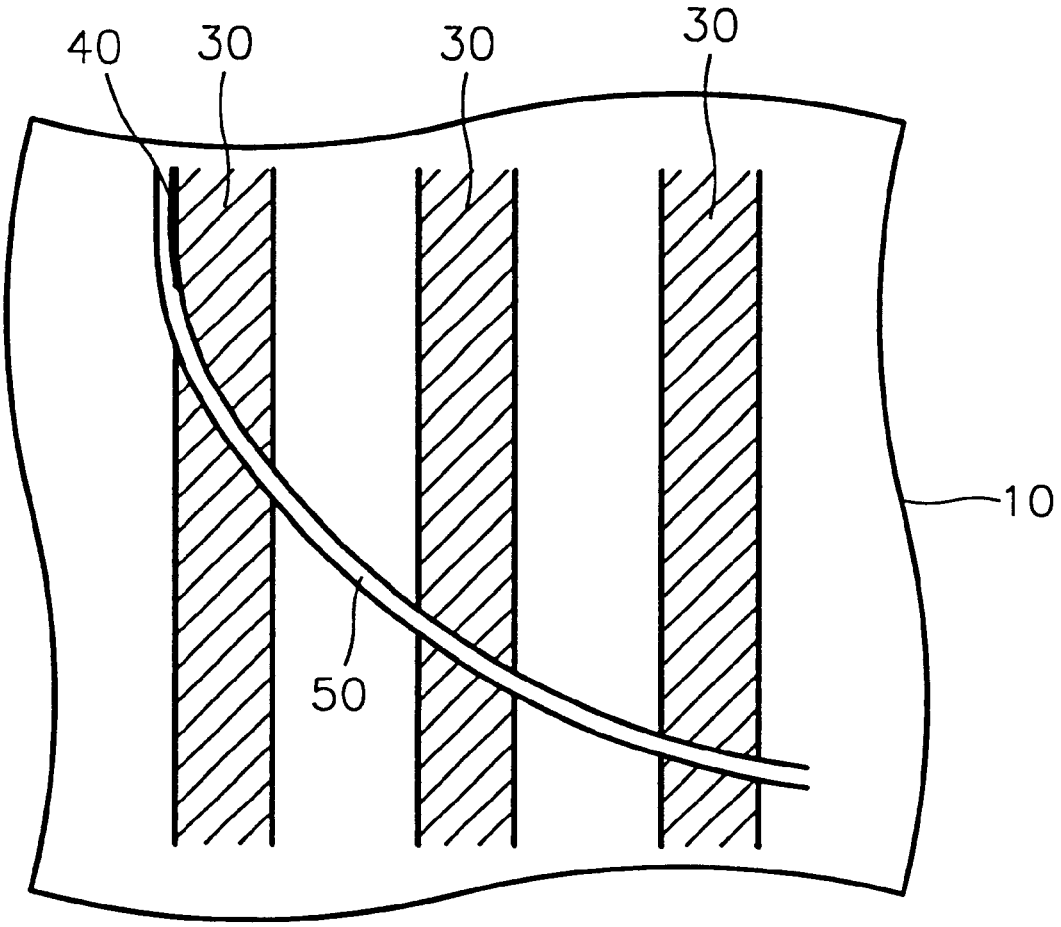
FIG. 2 PRIOR ART
FIG. 2 is a plan view of a conventional interconnection pattern in which cleaning is completed.
Figure 3:
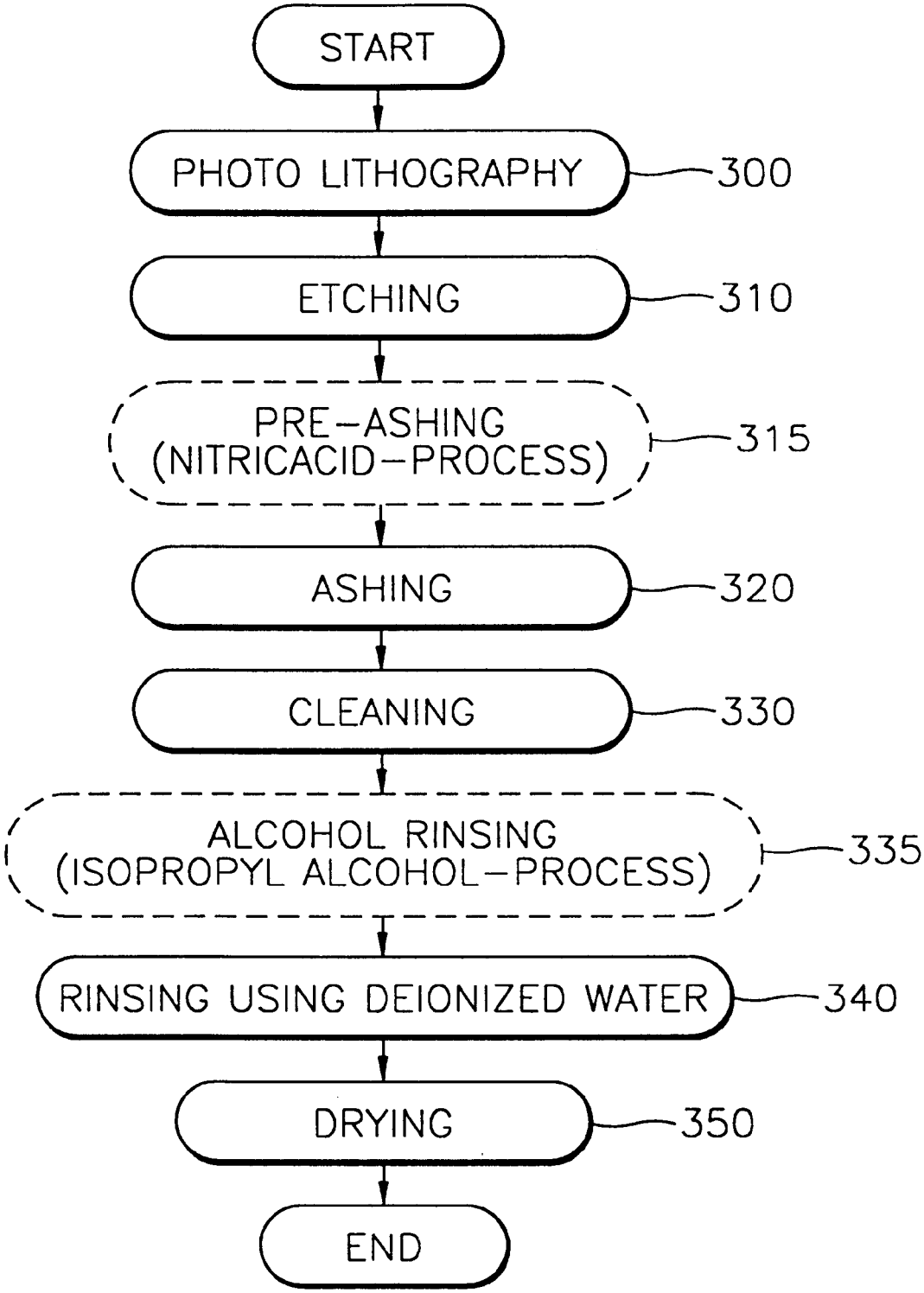
FIG. 3 is a flowchart, wherein the solid lines indicate a process of removing contaminants from the surface of an integrated circuit substrate using a cleaning solution according to the present invention, and the dashed lines indicate the conventional steps eliminated by the present invention.

As shown in FIG. 3, when the cleaning solution according to the present invention is used, a pre-ashing step (step 315) may be omitted. This is because the cleaning solution according to the present invention has strong cleaning ability. Particularly, the cleaning solution according to the present invention can easily remove various organic metallic polymers and the oxide which could not be removed by the conventional organic cleaning solution. Thus, the pre-ashing step (step 315) may be omitted.

Also, the cleaning solution according to the present invention has no organic solvent, so that the cleaning solution can be completely removed from the surface of the substrate by rinsing it with deionized water. Thus, the alcohol rinsing (isopropyl alcohol-process) step (step 335) required for the conventional organic cleaning solution is unnecessary.

As described above, the pre-ashing step and the isopropyl alcohol (IPA) rinse step are omitted, to thereby minimize the equipment for manufacturing the integrated circuit.

The present invention is described in more detail with reference to following embodiment examples, which describe, but should not be construed as limiting, the present invention.

EXAMPLE 1

Evaluation of Optimum pH of Cleaning Solution

Nine cleaning solution samples having different pH values ranging from high acidity to low alkalinity were provided to determine the pH having the optimum cleaning ability. A substrate having a titanium layer formed to a thickness of 980 Å was put in each of the cleaning solutions for 10 min to measure the etching rate. Also, a substrate having an oxide layer formed to a thickness of 1000 Å was put in each of the cleaning solutions to measure the etching rate. The etching rate of the titanium layer was measure to evaluate damage to a barrier metal layer, and the etching rate of the oxide layer was measured to evaluate the removing ability of the polymer and the oxide generated by overetching of the oxide layer under an interconnection. The result is shown in Table 1 and FIG. 4.

TABLE 1

| Cleaning solution | pH | Etching rate (Å/min) of titanium layer | Etching rate (Å/10 min) of oxide layer |
|---|---|---|---|
| 1 | 3.5 | greater than 98 | 4.6 |
| 2 | 3.8 | 90 | 4.6 |
| 3 | 4.5 | 0.1 | 4.7 |
| 4 | 4.6 | 0.1 | 4.6 |
| 5 | 4.65 | less than 0.1 | 4.5 |
| 6 | 5.1 | less than 0.1 | 4.5 |
| 7 | 6.3 | less than 0.1 | 3.7 |
| 8 | 7.0 | less than 0.1 | 1.8 |
| 9 | 8.8 | less than 0.1 | 1.0 |

Figure 4:
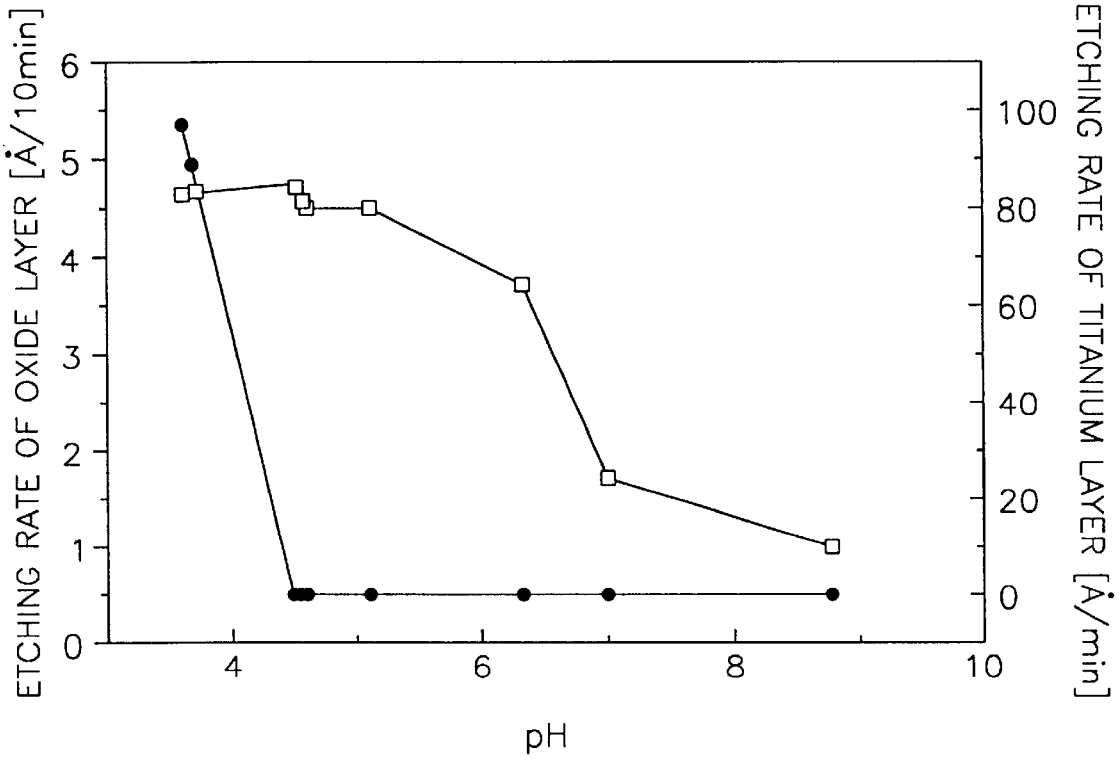
FIG. 4 is a graph showing the result of etching rates measured for an oxide layer and a titanium layer with respect to the pH to determine the optimum pH level of the cleaning solution according to the present invention.

As shown in Table 1 and FIG. 4, when the pH is 3.5, the etching rate of the titanium layer is 98 Å/min, and when the pH is 4.5 or more, the titanium layer is barely etched. When the titanium layer is formed as a barrier layer of an interconnection, the titanium layer is formed to a thickness of approximately 900 Å, and preferably, the pH of the cleaning solution is 3.5 or more considering the limit allowable value of the etching rate of the titanium layer during cleaning.

Also, the oxide layer is etched at a rate of 1 Å/10 min for the maximum pH of 8.8. Thus, the maximum range of pH of the cleaning solution is approximately 8.8. However, considering that the etching rate of the oxide layer in the pH range of 6–8.8 is less than 4 Å/10 min, and the polymer and oxide layers are completely removed in the predetermined cleaning time of 5–20 min, preferably, the pH is 6 or less.

EXAMPLE 2

Measuring the Optimum Content (wt %) of Hydrofluoride

In order to measure the optimum content wt % of hydrofluoride in the cleaning solution, solution A was provided in which $NH_4OH$, $CH_3COOH$ and deionized water were mixed in a weight ratio of 0.3:2:20.7. Seven cleaning solution samples of the mixing rate of the solution A and hydrofluoride 100:1–10,000:1 were provided. Subsequently, a substrate in which a titanium layer was formed to a thickness of 980 Å was put into the cleaning solution for 10 min to measure the etching rate. The result is shown in Table 2 and FIG. 5.

TABLE 2

| Cleaning solution | Weight ratio of A:HF | Content (wt %) of hydrofluoride | Etching rate (Å/min) of titanium layer |
|---|---|---|---|
| 1 | 100:1 | 1 | greater than 98 |
| 2 | 200:1 | 0.5 | 90 |
| 3 | 400:1 | 0.25 | 0.1 |
| 4 | 600:1 | 0.17 | 0.1 |
| 5 | 1,000:1 | 0.1 | 0.1 |
| 6 | 2,000:1 | 0.05 | less than 0.1 |
| 7 | 10,000:1 | 0.01 | less than 0.1 |

Note: solution A is a solution in which $NH_4OH$, $CH_3COOH$ and $H_2O$ are mixed in ratio of 0.3:2:20.7

Figure 5:
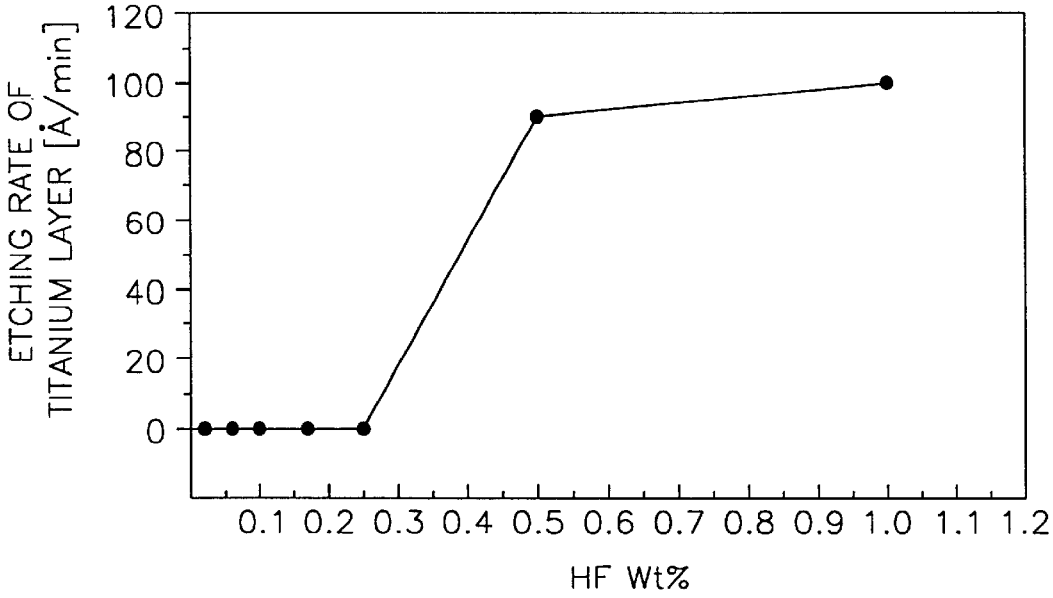
FIG. 5 is a graph showing the result of etching rates measured for the titanium layer with respect to the content of hydrofluoride (HF) in the cleaning solution according to the present invention.

Considering the result of Table 2 and FIG. 5, and the limit allowable value of the etch rate of a titanium barrier layer is 100 Å, preferably, the content of hydrofluoride is 0.01–1 wt %.

EXAMPLE 3

Determining Elements Having an Effect on Etching of Titanium Layer

The dissociation concentration of each of the composition elements with respect to the pH of the cleaning solution was measured to determine elements having an effect on the etching of a titanium layer. The result is shown in FIG. 6.

Figure 6:
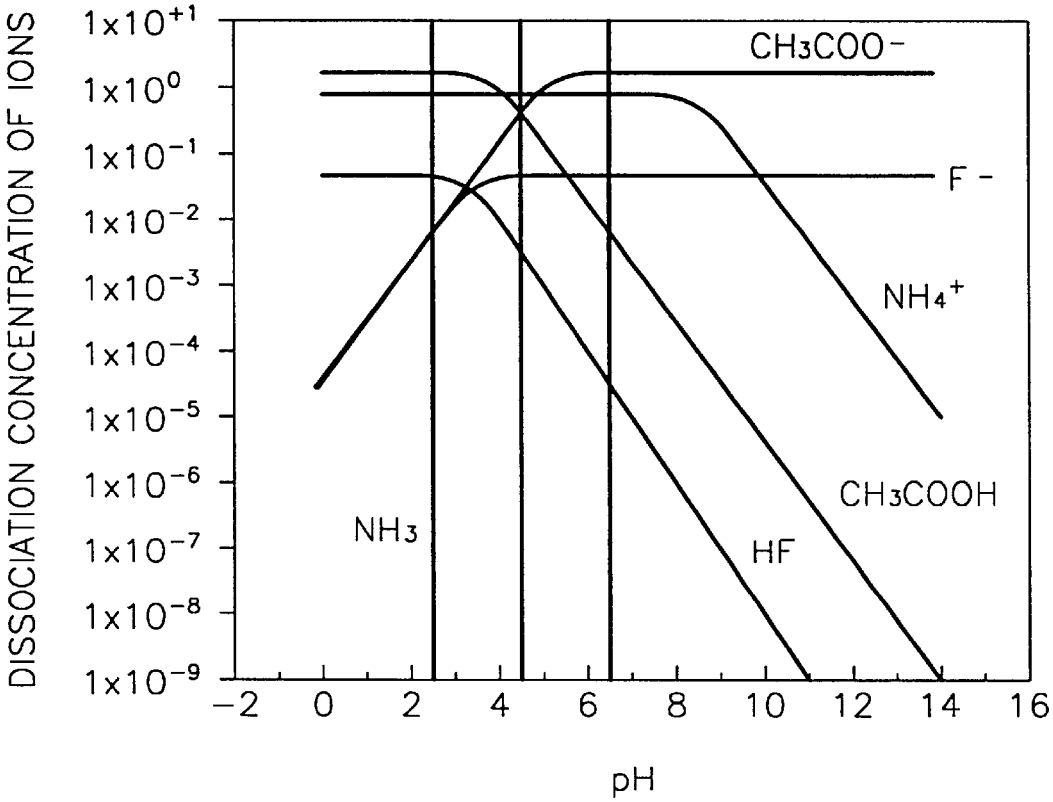
FIG. 6 is a graph showing dissociation rates of each of the elements with respect to the pH of the cleaning solution according to the present invention.
Figure 7A:
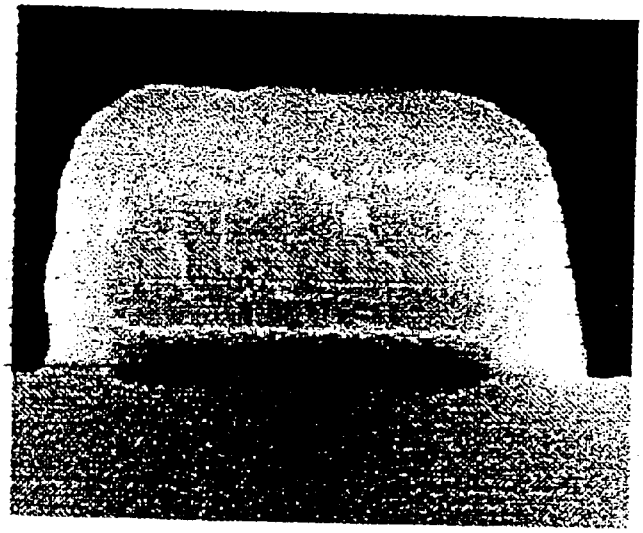
FIGS. 7A through 7D are scanning electron microscope (SEM) photographs of sections of tungsten interconnections treated by cleaning solutions having various mixing rates.
Figure 7B:
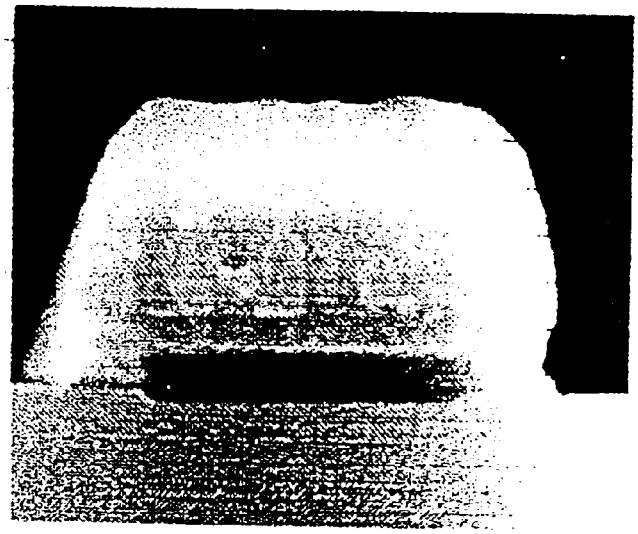
Figure 7C:
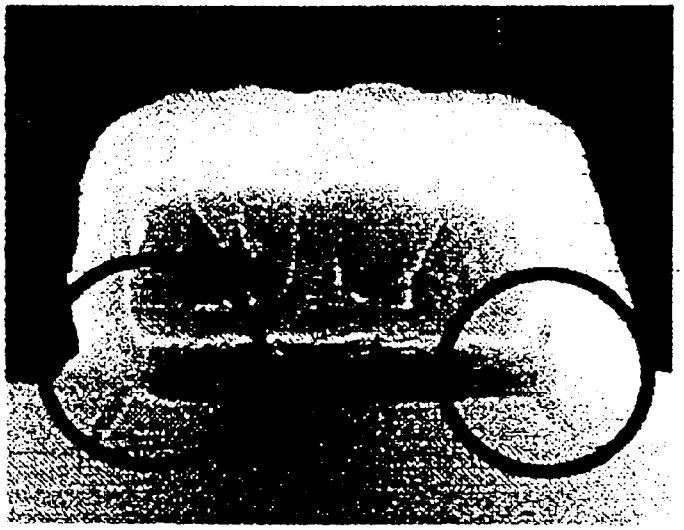
Figure 7D:
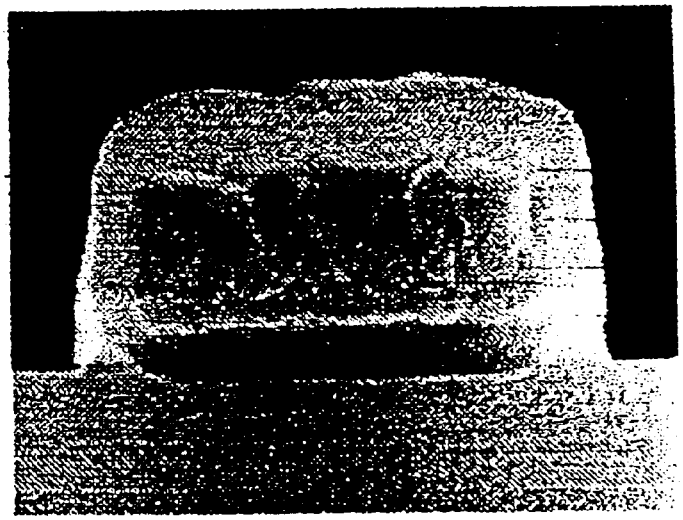
Figure 8A:
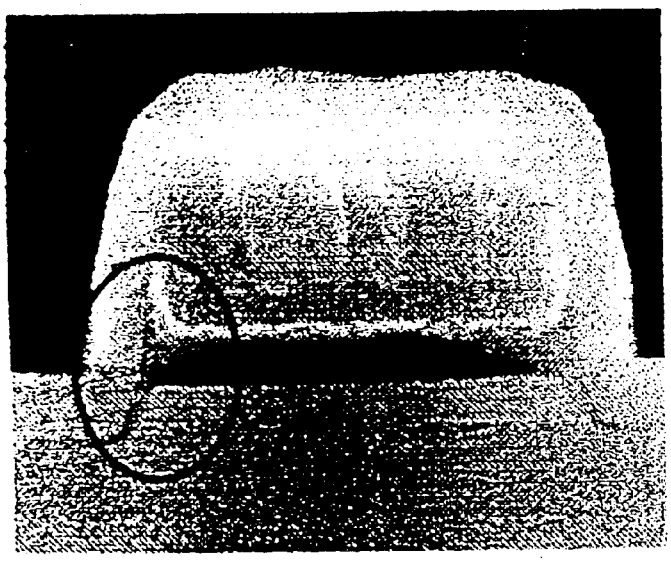
Figure 8B:
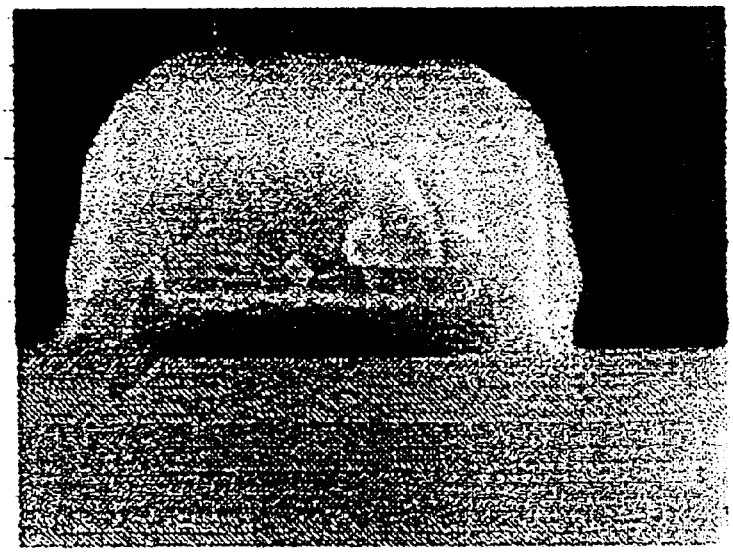
Figure 8C:
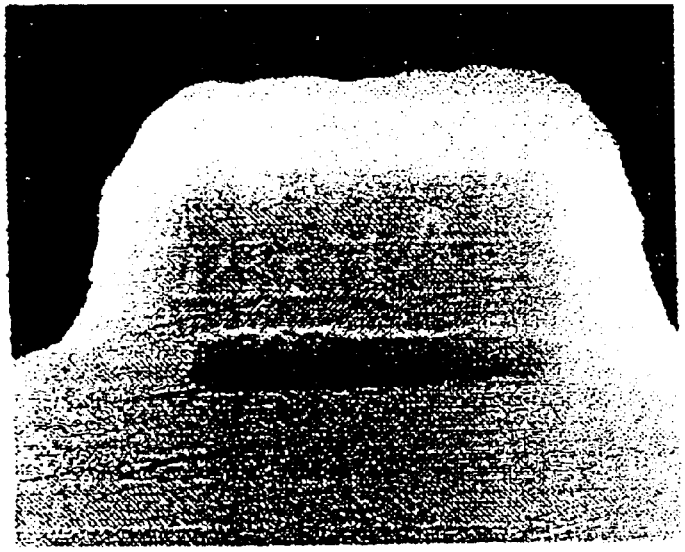
Figure 8D:
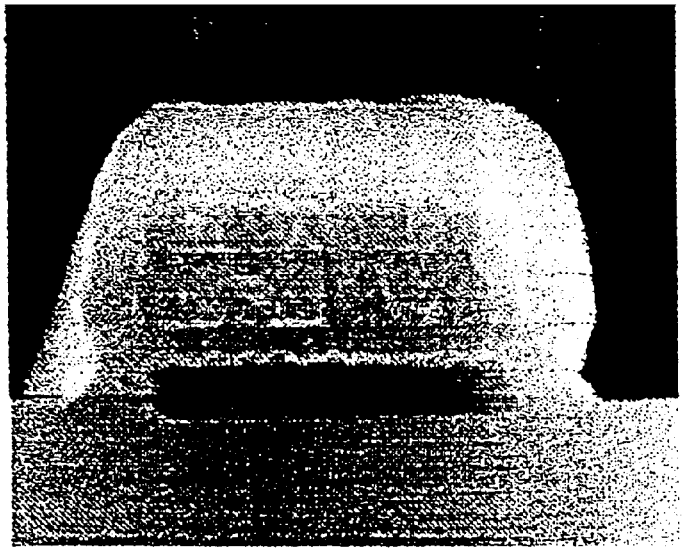

As shown in FIG. 6, at a pH of 3.5 or less in which the etching rate of the titanium layer is 98 Å/min or more, the dissociation rate of $F^-$ was remarkably reduced, and at a pH of 4.5 or less in which the etching rate of the titanium layer of 0 Å/min is increased to 98 Å/min, the dissociation rate of $CH_3COO^-$ was reduced. Thus, the elements having an effect on the etching of the titanium layer are a concentration of F–, i.e., $H^+$, and $CH_3COO^-$.

EXAMPLE 4

Selection of Optimum Cleaning Solution

Cleaning was performed under the conditions of Table 3 below to select a cleaning solution having excellent etching properties and removing ability of ashing residue.

TABLE 3

| Cleaning solution | Weight ratio of A:HF | pH | Content (wt %) of hydrofluoride | Cleaning time (min) |
|---|---|---|---|---|
| 1 | 400:1 | 4.5 | 0.25 | 5 |
| 2 | 1,000:1 | 4.6 | 0.1 | 5 |
| 3 | 2,000:1 | 4.65 | 0.05 | 5 |
| 4 | 2,000:1 | 4.65 | 0.05 | 20 |

Note: Solution A is a solution of $NH_4OH:CH_3COOH:H_2O$ having a weight ratio of 0.3:2:20.7

In a cleaning object sample, an oxide layer (plasma enhanced tetraethylorthosilicate) was formed on the entire surface of a substrate, and then a titanium layer, a titanium nitride layer, a tungsten layer and a SiON layer as an antireflective layer were sequentially formed. Subsequently, a photoresist pattern defining a tungsten interconnection was formed by the photo lithography process. Then, a silicon oxynitride layer, a tungsten layer, a titanium nitride layer and a titanium layer were sequentially etched using the photoresist pattern as an etching mask. A gas mixture of $SF_6$, $N_2$ and $Cl_2$ was used to etch the tungsten layer, and a gas mixture of nitrogen ($N_2$) and chlorine ($Cl_2$) was used to etch the titanium nitride layer and the titanium layer. After the tungsten interconnection was formed by etching, the photoresist pattern was removed by ashing using $O_2$ plasma.

The above cleaning objects were cleaned under the conditions shown in Table 3, and then the degree of cleaning was checked by a scanning electron microscope (SEM).

Here, it was difficult to check by SEM for the existence of residue remains on the surface of the interconnection. Thus, by using a following PE-SiN capping method, it was determined whether there was any existing residue. A plasma enhanced silicon nitride (PE-SiN) layer was deposited on the tungsten interconnection cleaned by the cleaning solution in Table 3 to a thickness of 1,500 Å, and the PE-SiN layer was thermally treated for 240 sec at 500–520° C. to activate the residue. If the residues remain in the surface of the interconnection after the cleaning process, the residues react with the PE-SiN layer. The residues reacted with the PE-SiN layer were selectively etched with respect to a normal PE-SiN layer. Thus, the residue was indirectly checked.

SEM photographs of samples 1 through 4 are shown in FIGS. 7A through 7D.

Samples 1 and 2 (FIGS. 7A and 7B) show that the residues were removed, and sample 3 (FIG. 7C) shows that the residue remained as shown in the portions enclosed by two circles. Sample 4 (FIG. 7D) in which the cleaning solution used was the same as that of sample 3 and the cleaning time was 20 min, shows that the residue was removed. When the cleaning solution treatment time is 5 min, a cleaning solution having weight ratio of A:HF of 400:1–1,000:1 is appropriate for the cleaning process.

EXAMPLE 5

Measuring Optimum Cleaning Time

The optimum cleaning time was measured using the cleaning solution A:HF having the weight rate of 1,000:1, which is the optimum cleaning solution in Example 4. The cleaning objects provided by the same method of that of Example 4 were cleaned under the conditions of Table 4.

TABLE 4

| Sample | Cleaning solution | Cleaning temperature (° C.) | Cleaning time (min) | Generation rate (%) of defect |
|---|---|---|---|---|
| 1 | none | N/A | 0 | 99% |
| 2 | EKC cleaning solution | 65 | 30 | 36% |
| 3 | Weight ratio of A:HF = 1,000:1 | Room temperature | 3 | 5% |
| 4 | Weight ratio of A:HF = 1,000:1 | Room temperature | 5 | 0% |

Note: EKC cleaning solution is a conventional solution of Hydroxylamine+alcohol+cathechol Note: Solution A is a solution of $NH_4H:CH_3COOH:H_2O$ having a weight ratio of 0.3:2:20.7

The results of the samples of Table 4 performed by PE-SiN capping method are shown in FIGS. 8A through 8D. In sample 1 which was not cleaned after ashing, there was a portion (defect) in which the residue remains are enclosed by the circle.

The generation rate of defects is obtained by observing the generated portions of defects from SEM photographs taken of various portions, e.g., an upper portion, a lower portion, a center portion, a left portion and a right portion, of a wafer and calculating the rate of defect generation with respect to all of the observed portions. Sample 1 (FIG. 8A) in which the cleaning solution was not treated had a defect rate of 99%, sample 2 (FIG. 8B) in which the conventional cleaning solution was used had a defect rate of 36%, and sample 3 (FIG. 8C) in which the cleaning solution according to the present invention was treated for 3 min had a defect ratio of 5%. However, in sample 4 (FIG. 8D) in which the cleaning solution according to the present invention was treated for 5 min, there was no defect.

Thus, when the cleaning solution according to the present invention was treated for 5 min or more, it was shown to completely remove the etching and ashing residue.

EXAMPLE 6

Comparison of the Cleaning Ability of the Cleaning Solution According to the Present Invention with that of the Conventional Cleaning Solution Cleaning as shown in Table 5 was performed to compare the cleaning ability of the cleaning solution according to the present invention with that of the conventional cleaning solution.

TABLE 5

| Sample | Cleaning solution | Cleaning time (min) |
|---|---|---|
| 1 | EKC cleaning solution | 20 |
| 2 | Hydrofluoride:ammonium:deionized water = 1:15:1,036 | 5 |
| 3 | Hydrofluoride:acetic acid:deionized water = 1:100:101 | 5 |
| 4 | A:hydrofluoride = 1,000:1 | 5 |

Note: EKC cleaning solution is a conventional cleaning solution of hydroxylamine+alcohol+catechol Note: Solution A is a solution of $NH_4OH:CH_3COOH:H_2O$ having a weight ratio of 0.3:2:20.7

Figure 9A:
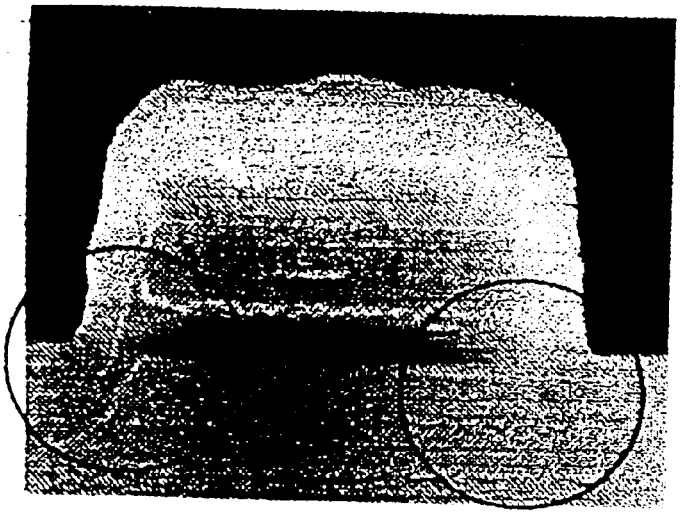
Figure 9B:
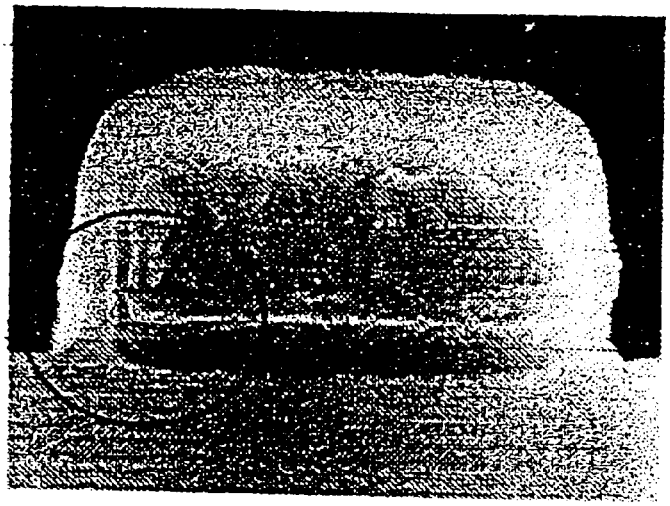
Figure 9C:
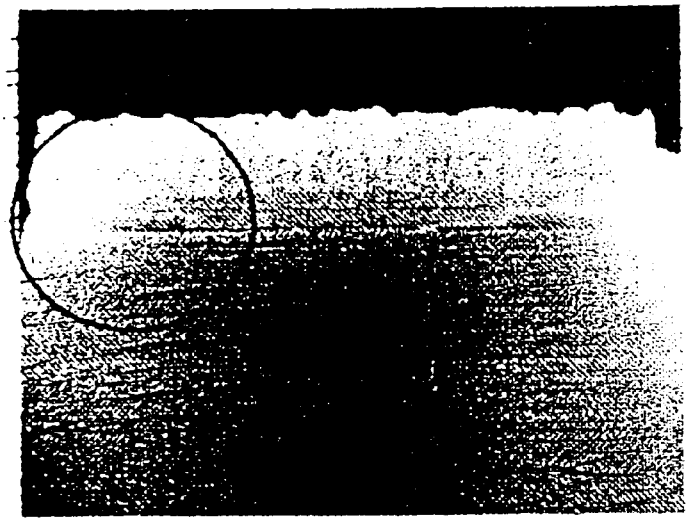
Figure 9D:
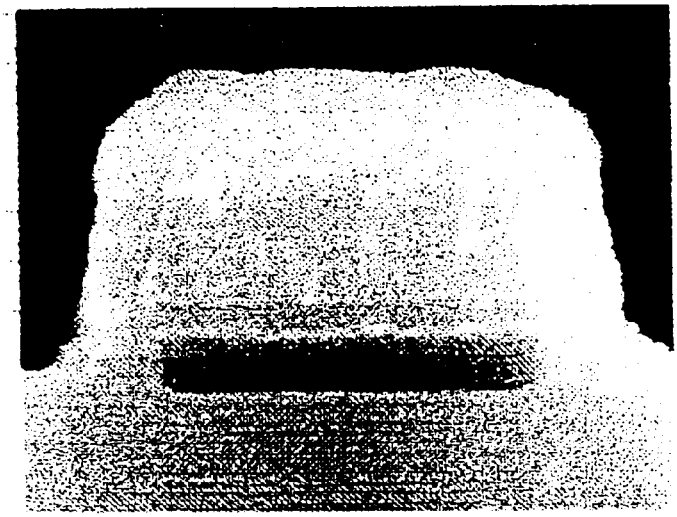

FIGS. 9A through 9D show SEM photographs of samples in which each of the samples was cleaned and the PE-SiN capping process was completed. A defect indicated by the area enclosed by the circle was generated in samples 1 and 2 (FIGS. 9A and 9B). Also, in sample 3 (FIG. 9C) using a solution mixture of hydrofluoride and acetic acid, the titanium layer of a barrier layer was damaged and a tungsten interconnection pattern was lifted so that the PE-SiN capping process could not be performed. However, it is shown that the residues were removed in sample 4 (FIG. 9D) in which the cleaning solution according to the present invention was applied.

EXAMPLE 7

Measuring Cleaning Ability of a Real Device

A first interconnection of a multi-interconnection structure of a real device was formed by a photolithographic process, and then the resultant structure was cleaned by a conventional EKC cleaning solution and the cleaning solution according to the present invention having a weight ratio in which A:HF was 1,000:1, to observe the upper surface by SEM and to measure leakage current. It can be seen that in a sample (FIG. 10A) cleaned by the conventional EKC cleaning solution, the sidewall polymer partially remained, and in a sample (FIG. 10B) which was cleaned by the cleaning solution according to the present invention, the residue was completely removed.

Also, it can be understood that the leakage current of a sample (No. 1 of FIG. 11) cleaned by the cleaning solution according to the present invention was less that of a sample cleaned by the conventional EKC cleaning solution (No. 2 of FIG. 11).

In summary, the cleaning solution according to the present invention has excellent cleaning ability with respect to various types of organic metallic polymer as well as organic polymer. Thus, the pre-ashing step for removing the organic metallic polymer is unnecessary. Also, the cleaning solution according to the present invention can be completely removed from the surface of the substrate by rinsing it with deionized water, since it is an aqueous solution. Thus, rinsing can be performed by the deionized water without the IPA rinse step required by the conventional organic cleaning solution. Thus, when the cleaning solution according to the present invention is used, the cleaning step is simplified and the equipment for manufacturing an integrated circuit is minimized. Also, the cleaning solution according to the present invention has excellent removing ability with respect to the oxide or the metallic oxide, and suppresses a bridge phenomenon found with the conventional organic cleaning solution. Also, the conductive layer is barely corroded, so that the cleaning solution is appropriate for the process of forming an interconnection or a contact hole (via hole). Also, the cleaning solution according to the present invention is used at room temperature and for short time periods, while still maintaining its excellent cleaning ability, so that the usable life span of the cleaning solution is long.

The present invention is not limited to the embodiments set forth above, and it is clearly understood that many variations may be made within the scope of the present invention by anyone of skill in the art.

What is claimed is:

1. A cleaning solution for removing contaminants from an integrated circuit substrate, comprising:

a fluoride reducing agent in an amount of 0.01–1% by weight based on the total weight of the cleaning solution;

an organic acid containing a carboxyl group selected from the group consisting of acetic acid ($CH_3COOH$) and citric acid ($C_3H_4(OH)(COOH)_3$) in an amount of 9–50% by weight based on the total weight of the cleaning solution;

an alkaline pH controller selected from a group consisting of ammonium hydroxide ($NH_4OH$) and potassium hydroxide (KOH) in an amount of 1.2–15% by weight based on the total weight of the cleaning solution; and water.

2. The cleaning solution of claim 1, wherein a pH range of the cleaning solution is 3.5–8.8.

3. The cleaning solution of claim 1, wherein a pH range of the cleaning solution is 3.5–6.

4. The cleaning solution of claim 1, wherein the fluoride reducing agent is one selected from a group consisting of a hydrofluoride (HF), a hydroboron tetrafluoride ($HBF_4$), and ammonium fluoride ($NH_4F$).

5. The cleaning solution of claim 1, wherein the organic acid is acetic acid.

6. A method for removing contaminants from an integrated circuit substrate, comprising a step of applying a cleaning solution to a surface of the integrated circuit substrate wherein the cleaning solution contains (a) a fluoride reducing agent in an amount of 0.01–1% by weight based on the total weight of the cleaning solution, (b) an organic acid containing a carboxyl group selected from the group consisting of acetic acid ($CH_3COOH$) and citric acid ($C_3H_4(OH)(COOH)_3$) in an amount of 9–50% by weight based on the total weight of the cleaning solution, (c) an alkaline pH controller selected from a group consisting of ammonium hydroxide ($NH_4OH$) and potassium hydroxide (KOH) in an amount of 1.2–15% by weight based on the total weight of the cleaning solution, and (d) water.

7. The method of claim 6, wherein the contaminants are at least one of an etching residue, polymer, an organic metallic polymer, a silicon oxide layer, and a contaminated silicon oxide layer.

8. The method of claim 6, wherein a surface of the integrated circuit substrate is partially metallic.

9. The method of claim 6, wherein a pH range of the cleaning solution is 3.5–8.8

10. The method of claim 6, wherein a pH range of the cleaning solution is 3.5–6.

11. The method of claim 6, wherein the fluoride reducing agent is one selected from a group consisting of a hydrofluoride (HF), a hydroboron tetrafluoride ($HBF_4$), and ammonium fluoride ($NH_4F$).

12. The method of claim 6, wherein the cleaning solution is applied at room temperature.

13. The cleaning solution of claim 6, wherein the organic acid is acetic acid.

* * * * *